US005155800A

United States Patent [19]

Rezabek et al.

[11] Patent Number: 5,155,800

[45] Date of Patent: Oct. 13, 1992

[54] PANEL HEATER ASSEMBLY FOR USE IN A CORROSIVE ENVIRONMENT AND METHOD OF MANUFACTURING THE HEATER

[75] Inventors: Dennis J. Rezabek, Kirtland, Ohio; Robert J. Walty, Encinitas, Calif.

[73] Assignee: Process Technology Inc., Mentor, Ohio

[21] Appl. No.: 661,179

[22] Filed: Feb. 27, 1991

[51] Int. Cl.[5] ..... H05B 3/40; H05B 1/02

[52] U.S. Cl. ..... 392/503; 392/497; 219/523; 219/543; 219/544

[58] Field of Search ..... 392/503, 435–436, 392/438; 219/523, 543, 544, 213, 528, 548, 549; 338/308, 309

[56] References Cited

U.S. PATENT DOCUMENTS

| | | | |
|---|---|---|---|
| 983,292 | 2/1911 | Kohn . | |
| 1,007,125 | 10/1911 | Madsen . | |
| 1,209,862 | 12/1916 | Lidberg | 219/523 |
| 1,407,692 | 2/1922 | Kuhn et al. . | |
| 1,437,166 | 11/1922 | Campbell et al. | 219/523 |
| 1,472,185 | 10/1923 | Mollenhauer . | |
| 2,007,111 | 7/1935 | Morgan . | |
| 2,448,417 | 8/1948 | Cecchini . | |
| 2,566,921 | 9/1951 | Briscoe | 219/523 |
| 2,859,321 | 11/1958 | Garaway | 219/543 |
| 3,454,746 | 7/1969 | Dubois | 392/435 |
| 3,657,517 | 4/1972 | Hoyt | 219/535 |
| 3,694,627 | 9/1972 | Blatchford et al. | 219/543 |
| 3,859,504 | 1/1975 | Motokawa et al. | 219/528 |
| 3,904,850 | 9/1975 | Johnson | 219/212 |
| 4,050,052 | 9/1977 | Reichelt et al. | 338/308 |
| 4,326,121 | 4/1982 | Welsby et al. | 219/523 |
| 4,429,215 | 1/1984 | Sakai et al. | 219/544 |
| 4,724,305 | 2/1988 | Iimura et al. | 338/309 |
| 4,818,842 | 4/1989 | Walty | 219/505 |
| 4,967,057 | 10/1990 | Bayless et al. | 219/213 |
| 5,109,473 | 4/1992 | Rezabek et al. | 392/497 |

*Primary Examiner*—Bruce A. Reynolds
*Assistant Examiner*—Jeffery: John A.

[57] ABSTRACT

An apparatus and a method of assembling a panel heater for use in a corrosive environment includes a planar heating element, a planar non-conductive carrier for supporting a conductive ground plane thereon, a planar heat sink supporting the heating element, and a fluoropolymer envelope enclosing the heating element, the carrier, the ground plane and the heat sink to protect same from corrosive environments. The heat sink and carrier have a coefficient of expansion which is substantially equal to minimize the effects of unequal expansion and contraction of the heater.

23 Claims, 2 Drawing Sheets

PANEL HEATER ASSEMBLY FOR USE IN A CORROSIVE ENVIRONMENT AND METHOD OF MANUFACTURING THE HEATER

BACKGROUND OF THE INVENTION

The present invention relates to a new and improved flat panel heater assembly for use in a corrosive environment and a method of manufacturing the heater assembly.

Heater assemblies are well known for use in a corrosive environment such as in electroplating or industrial dipping where acid baths and other corrosive fluids are utilized. These heater assemblies come in a wide variety of configurations, such as that disclosed in the Sakai U.S. Pat. No. 4,429,215 entitled Planar Heat Generator. The known planar heater assemblies suffer from the disadvantage that they are not readily and cost-effectively manufacturable, and due to the fact that many are not adequately sealed, they are subject to the corrosive effects of the hostile environment in which they may be located.

The panel heater of the present invention is particularly adapted for use in hostile wet chemistry environments such as heating a bath of acid or other corrosive fluid. The present heater is adapted to be directly inserted into the acid bath to effect heating thereof. The heater assembly is constructed and encapsulated with a fluoropolymer material which effectively seals the heating element and prevents the corrosive environment, such as the acid, from coming in contact therewith. If the corrosive environment or acid were to come in contact with the heating element, the heating element would fail. The encapsulation of the heater assembly to prevent the penetration of the corrosive environment into the heater assembly is critical. Some of the prior art attempts to eliminate the contact between the heating element and the corrosive environment by physically locating the heater element outside of the corrosive environment. For example, it is known to attach a flat planar heating element to the outside of a container which contains the acid bath and then heat the container and the acid therein. While this construction eliminates contact between the heater element and the corrosive environment, it does not provide for the most efficient transfer of heat to the acid bath.

SUMMARY OF THE INVENTION

An improved panel heater for use in a corrosive environment is provided wherein a planar heating element is sealed in a fluoropolymer envelope which is adapted to be placed in direct contact with the corrosive environment to effect heating thereof. The heater for use in the corrosive environment includes a pair of planar heating elements which are operatively connected to a planar heat sink. A planar conductive ground is bonded to the outside of each of the planar heating elements and a fluoropolymer envelope encloses the ground plane, the heat sink, and the heating elements to protect the heater elements, the ground plane and the heat sink from corrosive environments.

The present invention further provides a panel heater as is set forth in the previous paragraph wherein the planar heat sink has a coefficient of expansion which is substantially equal to the coefficient of expansion of the planar heating elements and the bonding materials to thereby minimize the disadvantageous effects of unequal thermal expansion and contraction of different portions of the heater assembly to thereby minimize placing unequal stresses on the heater assembly so as to minimize the possibility of premature heater failure.

A further provision of the present invention is to provide a method of assembling a flat panel heater for use in a corrosive environment, including the steps of providing a planar heating element, supporting said planar heating element on a planar sink, supporting a conductive ground plane on the heating element, and encapsulating the planar heating element, the heat sink and the ground plane in a fluoropolymer envelope to protect the heating element, the heat sink and the ground plane from the corrosive environment.

Still another provision of the present invention is to provide a new and improved method of assembling a panel heater for use in a corrosive environment as is set forth in the preceding paragraph wherein the step of supporting the planar heating element on the planar heat sink includes the step of providing a heat sink having a coefficient of expansion which is substantially equal to the coefficient of expansion of the heating element to thereby minimize the effects of unequal expansion and contraction on the various elements.

BRIEF DESCRIPTION OF THE DRAWINGS

The foregoing and other objects and features of the present invention will become more apparent upon the consideration of the following description taken in connection with the accompanying drawings wherein.

DESCRIPTION OF THE PREFERRED EMBODIMENT OF THE INVENTION

Figure 1:
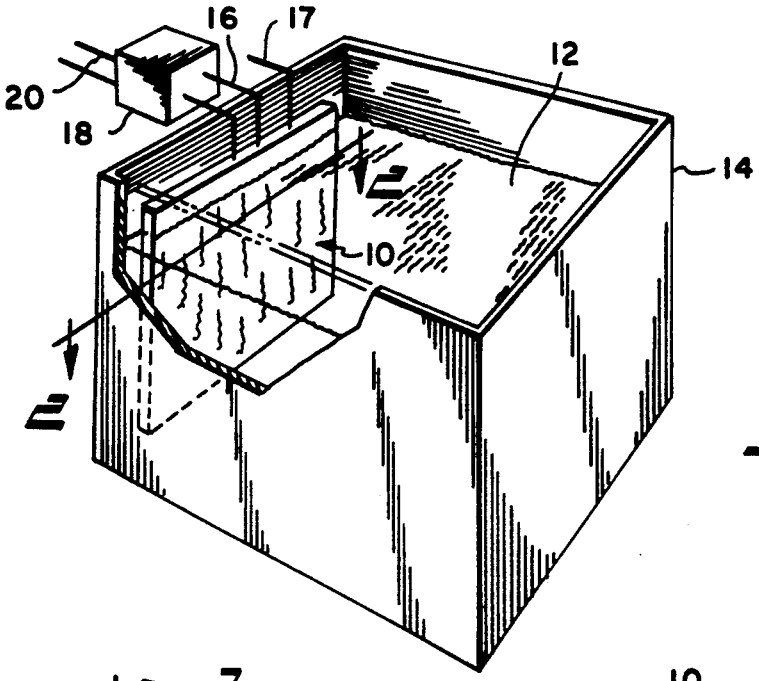
FIG. 1 is a simplified schematic of the present panel heater utilized to heat a fluid, such as acid, disposed in a container.

Referring to the figures and more particularly, to FIG. 1, a panel heater 10 is illustrated for use in heating a fluid 12 disposed in a container 14. The fluid 12 may be a corrosive fluid such as an electroplating solution or an acid cleaning bath. The heater 10 is provided with power via wires 16 which are connected to a control 18. A ground conductor 17 is also connected to the heater 10, as will be more fully described hereinafter, to provide protection in the event of an electrical fault. The control 18 is connected to a suitable source of power 20 and is operable to control the energization of the panel heater 10. The control 18 works in a well known manner to turn on and off the power to the panel heater 10 and to regulate a flow of power to the panel heater 10 to thereby control the temperature of the fluid 12. Suitable temperature sensing means, not illustrated, can be connected to the control 18 in a well known manner to provide a closed loop system to control the temperature of the fluid 12.

The panel heater 10, more fully illustrated in FIGS. 2 through 5, includes a planar heating element 22. In one preferred embodiment, illustrated in FIGS. 2 through 4, the heating element 22 is a printed ceramic heater which includes a stainless steel substrate 30, more fully illustrated in FIGS. 3 and 4, on which a ceramic heater 24 is disposed. The stainless steel substrate 30 acts as a heat sink, is thermally conductive, and provides structural strength to the heating element 22. A ceramic coating 25 is deposited onto the prepared stainless steel substrate 30 and the substrate is then dried and fired at red heat to permanently fuse the ceramic coating on the stainless steel substrate 30. The ceramic coating on the ceramic heater 24 offers excellent dielectric strength and outstanding resistance to harsh environments. The ceramic coating is screened with a resistive conductor pattern 27 such that a prescribed power output is achieved which in the preferred embodiment is 10 watts/square inch. The ceramic coating is then dried and refired to fuse the conductor pattern 27 onto the ceramic coating 25 and form the ceramic heater 24. The ceramic heating element 24 and stainless steel substrate 30 can be manufactured in large panels which can be cut into various sizes to accommodate various power requirements. It has been found that the ceramic heaters can generate a core temperature of 500 degrees Fahrenheit which can act to effectively heat fluids such as acids. A planar ceramic heater such as utilized in the present invention can be obtained from the Ferro-ECA Electronics Company located in Erie, Pa.

An electrically non-conductive carrier 26 having a stainless steel foil 28 applied only on one side is bonded to the ceramic heater 24 using a polyimide/glass adhesive layer 38. The electrically non-conductive carrier can be a polyimide/fiberglass carrier 26. The steel foil 28 on the carrier 26 forms a ground plane which is supported on the opposite side of the carrier 26 from the ceramic heater 24. While the ground plane is preferably formed of stainless steel, it could also be formed of other metals such as copper. The steel foil 28 provides a ground path for any stray current which may pass from the heating element 22 and protects the heater assembly 10 in the event of penetration of the fluid 12 into the heater assembly 10. The steel foil 28 provides a ground path which minimizes the possibility of stray currents passing to the fluid 12 and injuring a user of the heater 10. The steel foil 28 is connected to the ground conductor 17 to provide a ground path away from the heater 10. The steel foil 28 and polyimide/fiberglass carrier 26 can be formed from a standard single-sided polyimide/-fiberglass printed circuit board. Conductors 16 provide power to the conductive pattern 27 and are attached thereto by suitable solder terminals 19. Conductors 17, which are connected to ground at one end thereof, are connected to the ground plane 28 by suitable solder terminals 15.

The stainless steel substrate 30 provides for uniform distribution and dissipation of heat from the ceramic heating element 24 to the fluid 12 in which the heater 10 is disposed. In a preferred construction, the stainless steel heater blade or heat sink 30 is planar in construction and is formed from 304L stainless steel or 304ELC low carbon stainless steel which has a coefficient of expansion which is substantially equal to the coefficient of expansion of the polyimide/fiberglass carrier 26 and the ceramic heater 24. Thus, when the heater 10 is energized, the carrier 26, the ceramic heater 24, and the heater blade 30 will expand and contract at substantially the same rate to minimize stresses placed in the heater assembly 10.

Figure 3:
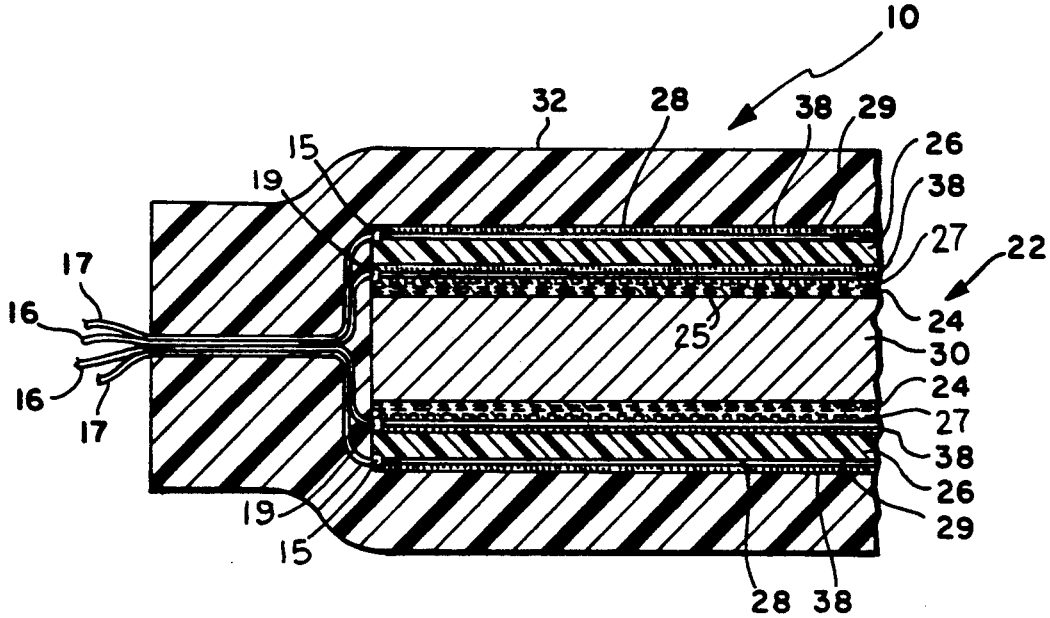
FIG. 3 is an enlarged schematic illustration illustrating the heater construction in more detail.
Figure 4:
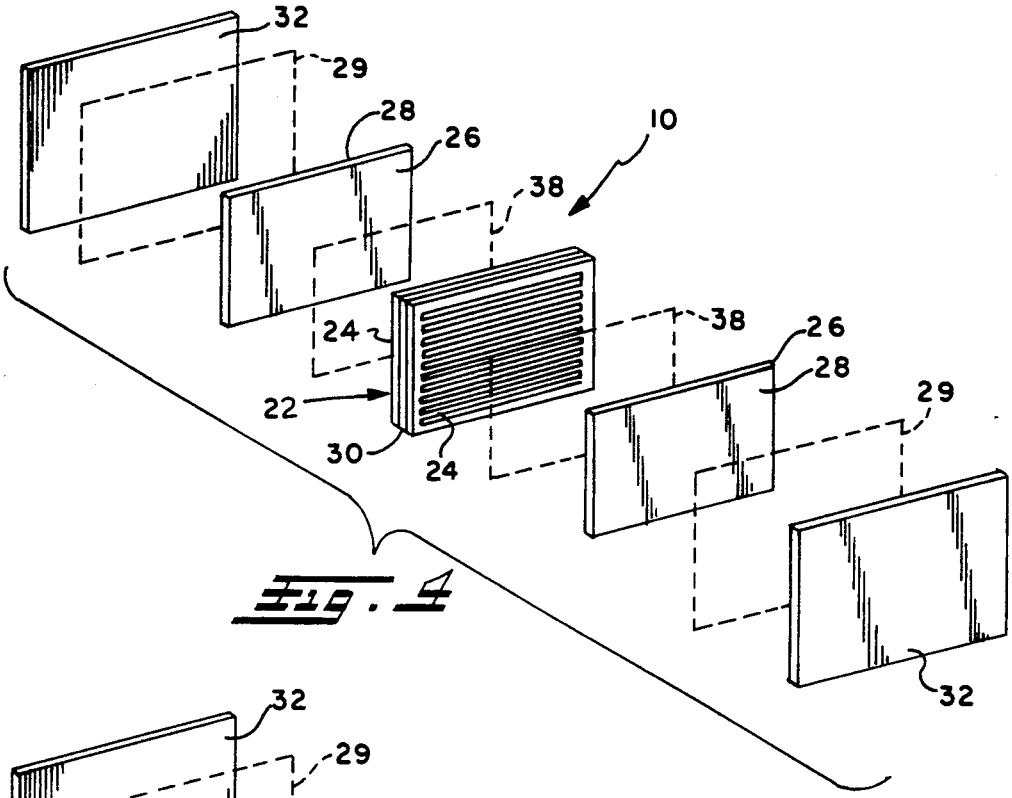
FIG. 4 is a schematic representation of the heater of FIG. 3.

A heating element 24 can be disposed on one side of the heater blade 30 or can be preferably disposed on both sides of the heater blade 30 to increase the power capacity of the heater assembly. FIGS. 3 and 4 schematically disclose an assembly wherein a heater element 24 is bonded to each side of the stainless steel substrate 30. This increases the power output of the heater assembly per square inch.

After the ground plane 28 with its polyimide/fiberglass carrier 26 are placed on the ceramic heating element 24 and the stainless steel substrate 30, a fluoropolymer sheath which is preferably perfluoroalkoxy 32 is disposed about the entire assembly of ceramic substrate 24, the carrier 26, the ground plane 28, and the stainless steel heat sink 30, to protect the heater element, the carrier, the ground plane and the heat sink from corrosive environments. The fluoropolymer sheath 32 can be vacuum molded about the ground plane 28, the carrier 26, the heater element 24, and the heat sink 30, to seal the heater assembly 10 from corrosive environments. Vacuum molding reduces the residual vapor pressure, removes any volatiles and removes any voids, and provides excellent sealing of the assembly. Adhesive such as a polyimide/glass adhesive layer 29 can be utilized between the ground plane and the fluoropolymer sheath 32 to bond the teflon sheath to the ground plane. To further insure that a fluid impenetrable seal is provided about the edge of the fluoropolymer sheath, heat sealing is used. If a thermoplastic fluoropolymer such as PFA polycholorotrifluoroethylene is used for the sheath 32, the thermoplastic fluoropolymer is welded to itself to provide a lip seal. Other fluoropolymers such as PTFE which are not thermoplastic can be used for the sheath 32 but may require an intermediate thermoplastic layer to promote adhesion at the lip seal. The power conductors 16 and ground conductors 17 pass between the sealed edges of the lip seal formed on the fluoropolymer sheath 32, and the sheath 32 seals the openings through which the conductors 16 and 17 pass.

Figure 2:
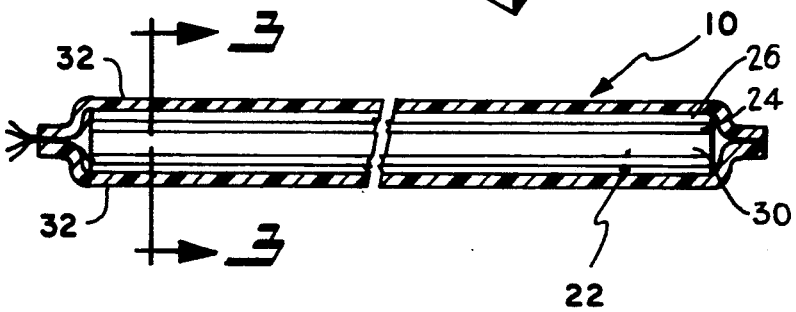
FIG. 2 is a schematic cross-section of the heater construction of the present invention.

While FIGS. 2 through 4 disclose the use of a ceramic heating element 24 disposed on both sides of the stainless steel heat sink 30, it should be appreciated that a ceramic substrate 24 could only be provided on a single side of the stainless steel substrate 30. In the event the ceramic substrate 24 is provided only on a single side of the stainless steel substrate 30, a single ground panel composed of a single-sided stainless foil/polyimide core printed circuit laminate having a ground plane 28 on one side can be utilized rather than a pair disposed on each side of the stainless steel substrate 30 as is illustrated in the figures.

While a deposited ceramic heater 24 on a stainless steel substrate 30 has been disclosed, other types of planar heater assemblies 22 could be utilized. For example, an etched foil copper heater 36 could be utilized disposed on a polyimide/fiberglass carrier. Other types of heating elements which are printed or electrodeposited could also be utilized.

Figure 5:
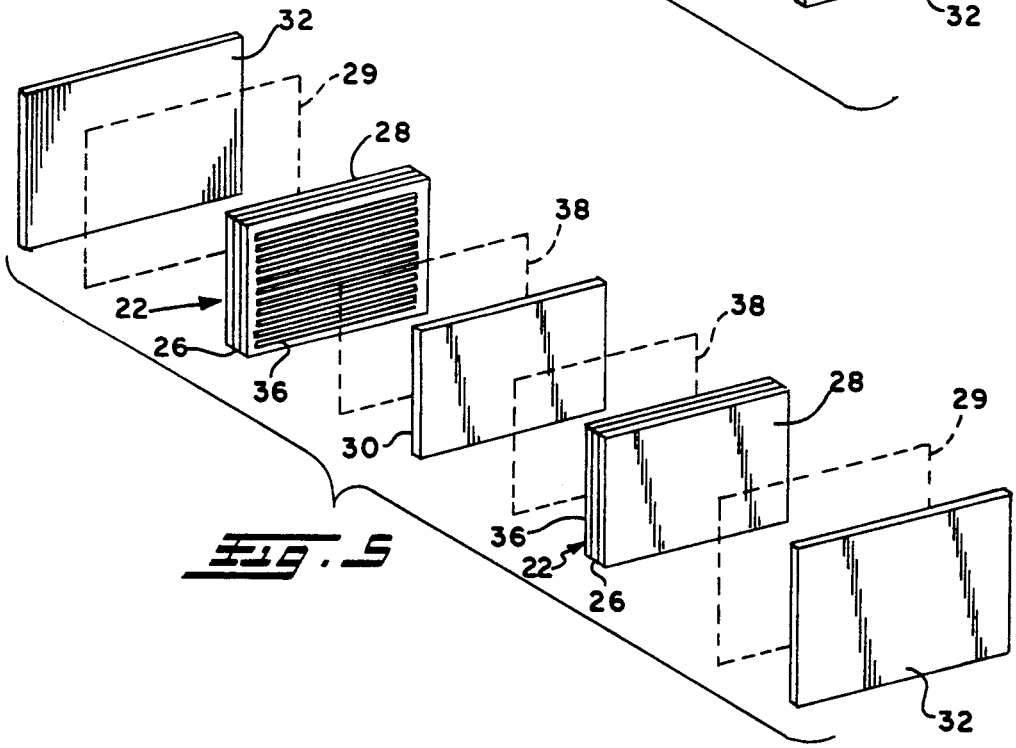
FIG. 5 is a schematic representation of a further embodiment of the invention utilizing a printed copper foil heating element.

FIG. 5 more fully discloses the planar heater assembly 22 which utilizes an etched foil copper heating element 36. In FIG. 5, a pair of planar heater assemblies 22 are provided. The heater assembly is a standard double-sided copper foil/polyimide glass core printed circuit laminate. The carrier 26 in FIG. 5 is a polyimide fiberglass core on which is disposed the ground plane 28 on one side thereof and an etched foil copper heating element 36 on the opposite side thereof. The etched foil copper heater element 36 may be comprised of a fine line heater pattern which is etched on one side of the standard double-sided copper foil/polyimide glass core printed circuit laminate, The other side of the laminate is left intact to provide the ground plane 28 to draw off power in the event of a heater failure. The pair of heater elements 22 are bonded to each side of the stainless steel heat sink 30 by a polyimide/glass adhesive layer 38. The fluoropolymer sheath 32 is then vacuum formed about the stainless steel substrate 30 (which can be formed from 301 stainless steel) and the heater element 22. A polyimide/glass adhesive layer 29 can be disposed between the fluoropolymer sheath 32 and the heater elements 22 to further enhance the adhesion of the fluoropolymer layer 32 to the stainless steel substrate 24 and heater elements 22. While the heater elements 22 are preferably disposed on both sides of the 301 stainless steel substrate 30 to increase the power output of the heater assembly per square inch, a heater element 22 may only be disposed on one side of the stainless steel substrate 30.

The use of a polyimide/fiberglass printed circuit board 26 for supporting the heating element 24 and the ground plane 28 provides a carrier which has a coefficient of expansion which substantially matches the coefficient of expansion of the stainless steel heater substrate 30. The coefficient of expansion of the carrier 26 depends on its composition, i.e. the resin content and the fiberglass content. For practical laminates this ranges from approximately 11.5 ppm/deg. C. to approximately 23 ppm/deg. C. This construction reduces stresses within the heater over repeated heating and cooling cycles.

From the foregoing, it should be apparent that a new and improved panel heater assembly has been provided and a method of manufacturing the heater assembly. The panel heater is particularly adapted for use in a corrosive environment and is manufactured by providing a flat planar heating element disposed on a planar heat sink, providing a conductive ground plane on an electrically non-conductive carrier at a location spaced apart from the heating element and the heat sink and encapsulating the planar heating element, the non-conductive carrier, the heat sink and the ground plane in a fluoropolymer envelope to protect same from a corrosive environment.

What we claim is:

1. A method of assembling a panel heater for use in a corrosive environment comprising the steps of:

providing a planar heating element;

supporting said planar heating element on one side of an electrically non-conductive carrier with said planar heating element extending substantially uniformally over the entire extent of said one side of said non-conductive carrier;

supporting said non-conductive carrier on a planar heat sink with an electrically non-conductive material;

supporting a conductive planar ground plane which is substantially coextensive with said planar heating element at a location spaced apart from said heating element and said heat sink on said non-conductive carrier; and encapsulating said planar heating element, said non-conductive carrier, said heat sink, and said ground plane in a fluoropolymer envelope to protect said heating element, said carrier, said heat sink, and said ground plane from corrosive environments.

2. A method of assembling a panel heater for use in a corrosive environment as defined in claim 1 wherein said step of supporting said carrier on said heat sink includes the step of bonding a heat sink to said non-conductive carrier which has a coefficient of expansion which is substantial equal to the coefficient of expansion of said non-conductive carrier.

3. A method of assembling a panel heater for use in a corrosive environment as defined in claim 1 wherein said step of supporting said non-conductive carrier on said heat sink element includes the step of bonding to said carrier a stainless steel heat sink having a coefficient of expansion which is substantially equal to the coefficient of expansion of said non-conductive carrier.

4. A method of assembling a panel heater for use in a corrosive environment as defined in claim 3 wherein said step of supporting said planar heating element on a non-conductive carrier includes the step of providing a polyimide-fiberglass carrier.

5. A method of assembling a panel heater for use in a corrosive environment as defined in claim 1 wherein said step of encapsulating said planar heating element, said non-conductive carrier, said heat sink and said ground plane in a fluoropolymer envelope comprises the step of providing a perfluoroalkoxy envelope around said planar heating element, said non-conductive carrier, said heat sink, and said ground plane to protect said heating element, said carrier, said heat sink, and said ground plane from corrosive environments.

6. A method of assembling a panel heater for use in a corrosive environment as defined in claim 5 wherein said step of providing a planar heating element comprises the step of providing an etched copper heating element.

7. A panel heater for use in a corrosive environment comprising a planar heating element, a planar non-conductive carrier for supporting said heating element on one side thereof, said planar heating element extending substantially uniformally over the entire extent of said one side of said non-conductive carrier, a planar conductive ground plane supported on the opposite side of said non-conductive carrier and being substantially coextensive with said planar heating element, a rigid planar heat sink for supporting said non-conductive carrier and said heater element, and a fluoropolymer envelope enclosing said heater element, said carrier, said ground plane, and said heat sink to protect said heater element, said carrier, said ground plane and said heat sink from corrosive environments.

8. A panel heater for use in a corrosive environment as defined in claim 7 wherein said planar heat sink has a coefficient of expansion which is substantially equal to the coefficient of expansion of said non-conductive carrier.

9. A panel heater for use in a corrosive environment as defined in claim 7 wherein said planar heat sink comprises a flat planar stainless steel heat sink having a coefficient of expansion which is substantially equal to the coefficient of expansion of said non-conductive carrier.

10. A panel heater for use in a corrosive environment as defined in claim 7 wherein said fluoropolymer envelope comprises a perfluoroalkyoxy envelope enclosing said heating element, said carrier, said ground plane and said heat sink.

11. A panel heater for use in a corrosive environment as defined in claim 10 wherein said planar heat sink comprises a planar stainless steel heat sink having a coefficient of expansion which is substantially equal to the coefficient of expansion of said non-conductive carrier.

12. A panel heater for use in a corrosive environment as defined in claim 11 wherein said planar non-conductive carrier is a polyimide/fiberglass carrier.

13. A panel heater for use in a corrosive environment as defined in claim 12 wherein said planar heating element is an etched copper heating element.

14. A panel heater for use in a corrosive environment comprising a first planar heating element, a second planar heating element, a rigid planar heat sink for supporting said first planar heating element on one side thereof and for supporting said second planar heating element on the opposite side thereof and conducting heat from said first and second planar heating elements, each of said first and second planar heating elements extending substantially uniformally over the entire extent of the side of said planar heat sink on which said planar heating element is supported, and a fluoropolymer envelope enclosing said first and second planar heating elements and said planar heat sink to protect said heating elements and said heat sink from the corrosive environment.

15. A panel heater for use in a corrosive environment as defined in claim 14 further including a planar conductive ground plane disposed within said fluoropolymer envelope for conducting stray currents from said heating elements in the event the hostile environment penetrates said fluoropolymer envelope.

16. A panel heater for use in a corrosive environment as defined in claim 14 further including a first planar conductive ground plane disposed within said fluoropolymer envelope for conducting stray currents from said heating elements in the event the hostile environment penetrates said fluoropolymer envelope and a first planar electrically non-conductive carrier for supporting said first ground plane, said non-conductive carrier having a coefficient of expansion which is substantially equal to the coefficient of expansion of said heat sink.

17. A panel heater for use in a corrosive environment as defined in claim 16 wherein said first and second planar heating elements are bonded to said heat sink.

18. A panel heater for use in a corrosive environment as defined in claim 17 wherein said planar heating elements are ceramic heating elements, said heat sink is stainless steel, and said ceramic heating elements are bonded to said stainless steel heat sink.

19. A panel heater for use in a corrosive environment as defined in claim 16 further including a second planar nonconductive carrier and a second planar conductive ground plane disposed on said second planar nonconductive carrier, and wherein said first planar heating element is disposed on one side of said first electrically non-conductive carrier supported by said planar heat sink, and said planar conductive ground plane is disposed on the opposite side thereof.

20. A panel heater for use in a corrosive environment as defined in claim 19 wherein each of said first and second planar heating elements is an etched copper heating element.

21. A panel heater for use in a corrosive environment as defined in claim 19 wherein each of said etched copper heating elements is bonded to said planar heat sink with an electrically non-conductive adhesive.

22. A rigid panel heater for use in a corrosive environment comprising a planar heating element, a rigid planar heat sink for supporting said planar heating element and conducting heat from said planar heating element, a fluoropolymer envelope enclosing said planar heating element and said planar heat sink to protect said heating element and said heat sink from the corrosive environment, a planar conductive ground plane disposed within said fluoropolymer envelope for conducting stray currents from said heating element in the event the hostile environment penetrates said fluoropolymer envelope, a planar electrically non-conductive carrier for supporting said ground plane, said non-conductive carrier having a coefficient of expansion which is substantially equal to the coefficient of expansion of said heat sink, said planar heating element being disposed on one side of said planar heat sink and a second planar heating element disposed on the opposite side of said planar heat sink.

23. A panel heater for use in a corrosive environment as defined in claim 22 wherein said planar non-conductive carrier plane is disposed adjacent to said planar heating element and supports said ground plane in close proximity to said planar heating element and further including a second planar non-conductive carrier and a second planar conductive ground plane supported on such second carrier, said second carrier being disposed adjacent to said second planar heating element and supporting said second ground plane in close proximity to said second heating element.

* * * * *